US006951429B2

(12) United States Patent
Aoyama

(10) Patent No.: US 6,951,429 B2
(45) Date of Patent: Oct. 4, 2005

(54) FEED ASSISTANCE MEMBER AND A MEDIUM PROCESSING APPARATUS

(75) Inventor: Noboru Aoyama, Sagamihara (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/376,651

(22) Filed: Aug. 18, 1999

(65) Prior Publication Data

US 2001/0012465 A1 Aug. 9, 2001

(30) Foreign Application Priority Data

Aug. 18, 1998 (JP) ..... 10-231248

(51) Int. Cl.[7] ..... B41J 13/26

(52) U.S. Cl. ..... 400/630; 271/250

(58) Field of Search ..... 400/579, 630, 400/631, 632, 632.1, 633, 636, 641, 634, 637, 637.3; 271/227, 236, 237, 238, 245, 246, 248, 250, 10.05, 10.14, 10.16, 109, 119; 492/27, 30, 36

(56) References Cited

U.S. PATENT DOCUMENTS

| | | | | | |
|---|---|---|---|---|---|
| 5,088,848 | A | | 2/1992 | De Falco et al. | |
| 5,564,847 | A | * | 10/1996 | Patrick et al. | 400/642 |
| 5,630,583 | A | * | 5/1997 | Yergenson | 271/119 |
| 5,667,321 | A | * | 9/1997 | Sago | 400/642 |
| 5,746,426 | A | * | 5/1998 | Nakabayashi et al. | 271/119 |
| 5,846,008 | A | * | 12/1998 | Park | 400/634 |
| 5,897,259 | A | * | 4/1999 | Ahn | 400/629 |
| 5,954,328 | A | * | 9/1999 | Hatanaka | 271/119 |

FOREIGN PATENT DOCUMENTS

JP 02081842 3/1990

* cited by examiner

*Primary Examiner*—Ren Yan
(74) *Attorney, Agent, or Firm*—David W. Victor; Konrad Raynes Victor & Mann

(57) ABSTRACT

Provided is a medium feeding aparatus having at least one align roller to align medium in a path, wherein the align roller is positioned below the medium and is driven to transport the medium in the path. A feed assistance member includes a shaft and a feed assistance roller rotably mounted to the shaft and positioned to apply pressure on the medium in the path to stabilize the medium while the medium is being aligned in the path by the at least one align wherein the feed assistance roller is not vertically aligned with any roller.

37 Claims, 5 Drawing Sheets

Non-Rotatable
Member

FEED ASSISTANCE MEMBER AND A MEDIUM PROCESSING APPARATUS

BACKGROUND OF THE INVENTION

1. Field of the Invention

The present invention relates to an apparatus for feeding a medium, such as paper, in a medium processing device such as a printer. More particularly, the present invention relates to an improved apparatus for increasing the precision in a feed operation of the medium through the medium processing device.

2. Background Art

As is disclosed in U.S. Pat. No. 5,088,848 (assigned to Olivetti), shown in FIG. 5, the correction of position of an inserted medium is made by running the edges of the medium against a left guide 171, and shutters 121, 123, 125 and 127. Then the medium is fed into the processing device, such as a printer. FIG. 5 is a plan view of a portion of the medium processing device 100 parallel to a feed path.

In this approach, the medium 200 is inserted, and when an IN sensor (an insertion sensor) 163 is turned on, rotation of an align roller 151 arranged in a lateral direction and align rollers 141 and 143 arranged in a vertical direction is initiated.

The align roller 151 feeds the medium in a leftward direction, and the align rollers 141 and 143 feed the medium in a forward direction. The shape of these two kinds of rollers is oval rather than circular, as shown in cross section A—A and cross section B—B. These rollers contact with idlers 145 and 153, respectively, for each rotation of 180 degrees. The idlers 145 and 153 are applied with a bias force such as a spring in a direction toward the align rollers so that a proper feed force or a feed power (a force for sustaining the feed operation) is generated.

The top of the align roller 151 is shifted from the tops of the align rollers 141 and 143 by 190 degrees, as shown in FIGS. 5, to alternately feed the medium incrementally toward the leftward direction and then in the forward direction. That is, when one, such as the align roller 151, feeds, the medium, the other, such as align rollers 141 and 143, does not disturb the feed operation of the align roller 151. When align sensor 165 is turned off, align roller 151 is operated, and when align sensor 165 is turned on, align roller 151 is stopped. When sensor 161 is turned off, align rollers 141 and 143 are operated, and when align sensor 161 is turned on, align rollers 141 and 143 are stopped. Finally, medium 200 is stopped by the left guide 171 and shutters 121, 123, 125 and 127.

As shown in FIG. 7, when both align sensors 161 and 165 are turned on, the correction of position is considered to be completed, and align rollers 141, 143 and 151 are stopped. Then the shutters 121, 123, 125 and 127 are opened, and the medium is fed into the inside of the processing device by feed rollers 131 and 133, and a process, such as a print operation or a character recognition operation, is performed.

However, when the medium is very thin, or the surface of the medium is very smooth, a sufficient friction force between a back surface of the medium and a surface of a plate for supporting the medium is not generated. Accordingly, when the oval shaped align rollers 141, 143, and 151 do not contact the idlers 145 and 153, the inertia force of the medium 200 driven by the previous contact with the align rollers 141, 143 and 151 becomes larger than the friction force of the surface of the medium, so that an overrun of the medium 200 occurs. As a result, when the medium 200 runs against the left guide 171 or the shutters 121, 123, 125 and 127, a bounce back of the medium 200 occurs, so that a proper correction of position of the medium becomes impossible.

One approach to solve this problem is to decrease the inertia force of the medium to the same strength as the friction force of the medium by either decreasing the rotational speed of the align rollers 141, 143 and 151 or by using align rollers with a smaller diameter so as to decrease the amount of movement of the medium. This alternative approach, however, increases the time for processing the medium to an unacceptable level.

Accordingly, one object of the present invention is to provide a mechanism for feeding a medium at a high speed which is not affected by a physical characteristic, such as thinness or smoothness, of the medium.

Another object of the present invention is to provide a mechanism for realizing a high speed correction of position of the medium which is not affected by a physical characteristic of the medium.

Still another object of the present invention is to provide a feed mechanism for decreasing a shear force or a tension force applied to the medium to as small a value as possible.

Another object of the present invention is to provide an improved feed mechanism in which production cost is low and the number of fabrication steps are decreased to a minimum.

SUMMARY OF THE INVENTION

In the present invention, a weight idler is mounted for causing a proper frictional force to be generated on a medium, such as paper, that is being fed in a printer or similar paper handling devices. In one aspect of the present invention, the weight idler can move in a direction along a thickness of the medium to absorb a variation of the thickness of the medium. When the medium is inserted, the weight idler rides on the medium to cause a proper frictional force to be generated between the medium and a surface of a plate that supports the medium being fed. In this matter, an overrun of the medium caused by the feed operation of the rollers of a non-circular cross section is prevented.

In one aspect of the present invention, a feed assistance member is arranged in the feed path of a medium to be processed in a medium processing apparatus, the feed path including a roller of non-circular cross section for feeding the medium. The feed assistance member includes a roller portion and a shaft portion. The shaft portion of the feed assistance member is supported in a bracket so as to move by the thickness of the medium. The roller portion of the feed assistance member contacts the medium being fed to increase the frictional force that is generated on the medium.

The medium processing apparatus according to the present invention includes, but is not limited to, such apparatus as a printer, a facsimile device, a copying machine, and a character recognition device.

Another aspect of the present invention is a feed assistance member arranged in a feed mechanism including a feed member, the feed power of which changes during the feed of a medium, such as paper. Such feed assistance member contacts the medium being fed in a manner so as to increase the frictional force generated on the medium with the feed assistance member being arranged so as to move by the thickness of the medium.

BRIEF DESCRIPTION OF THE DRAWINGS

FIGS. 8 and 9 illustrate further operations of the existing medium processing device.

DESCRIPTION OF PREFERRED EMBODIMENT

Figure 1:
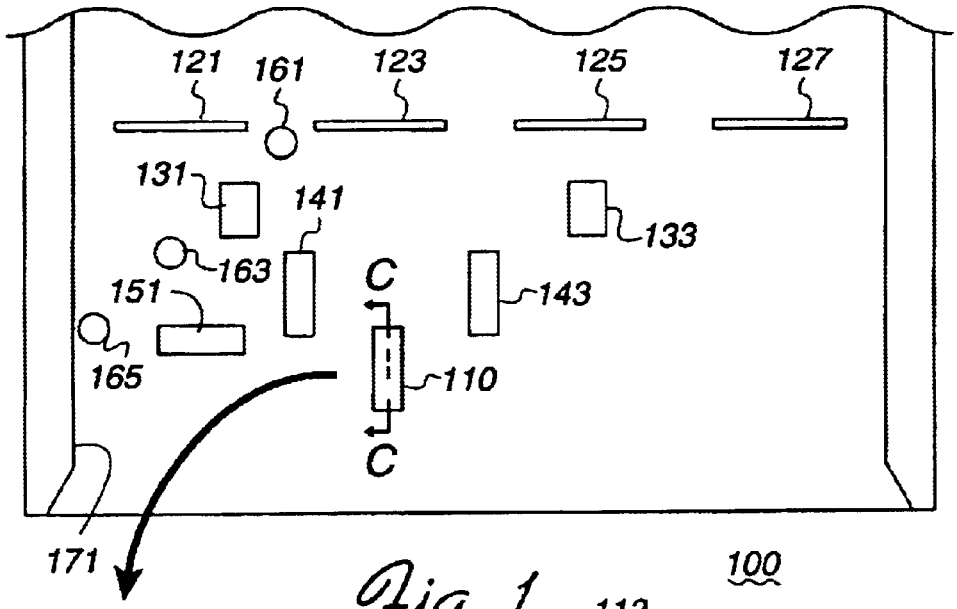
FIG. 1 shows one embodiment of the medium processing device of the present invention.
Figure 6:
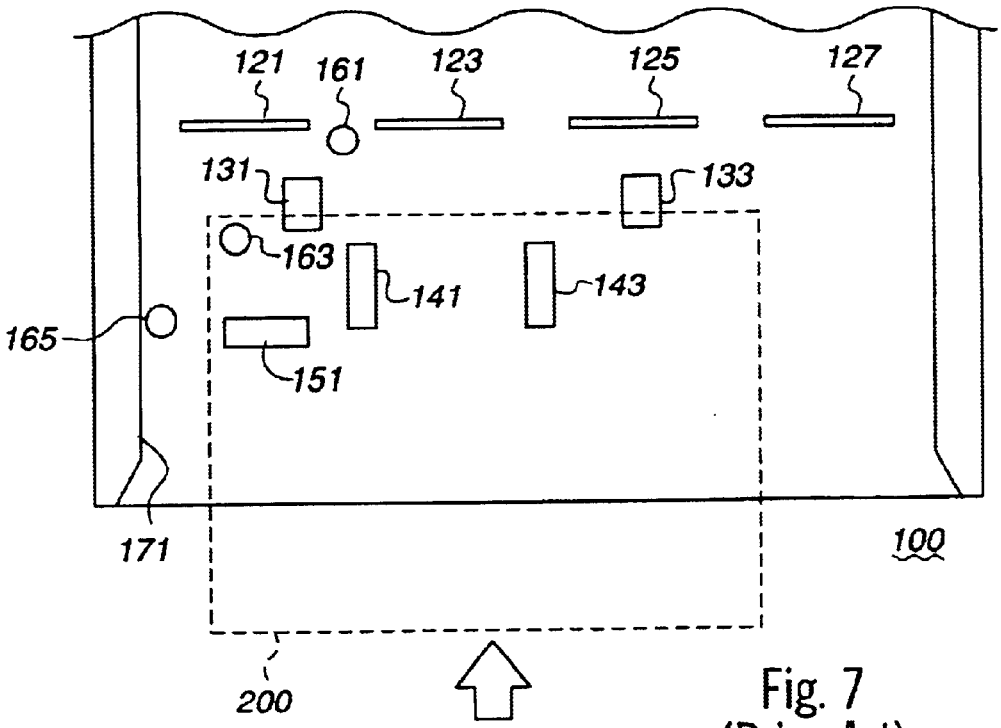
Fig. 6 (Prior Art)
FIG. 6 shows the operation of an existing medium processing device.
Figure 7:
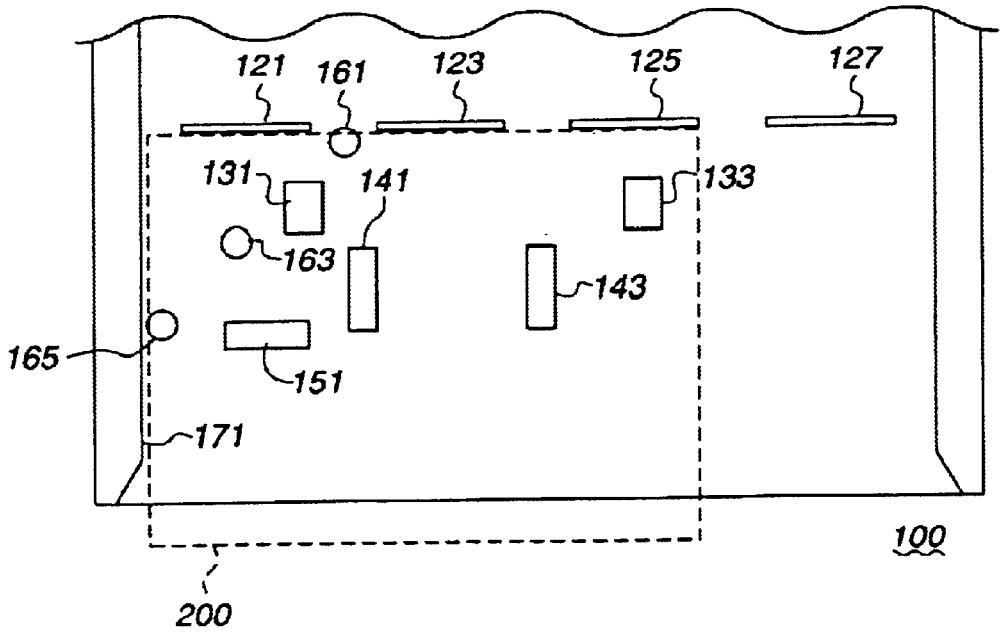
Fig. 7 (Prior Art)
FIGS. 7, 8, and 9 shows the further operation of the existing medium processing device.
Figure 8:
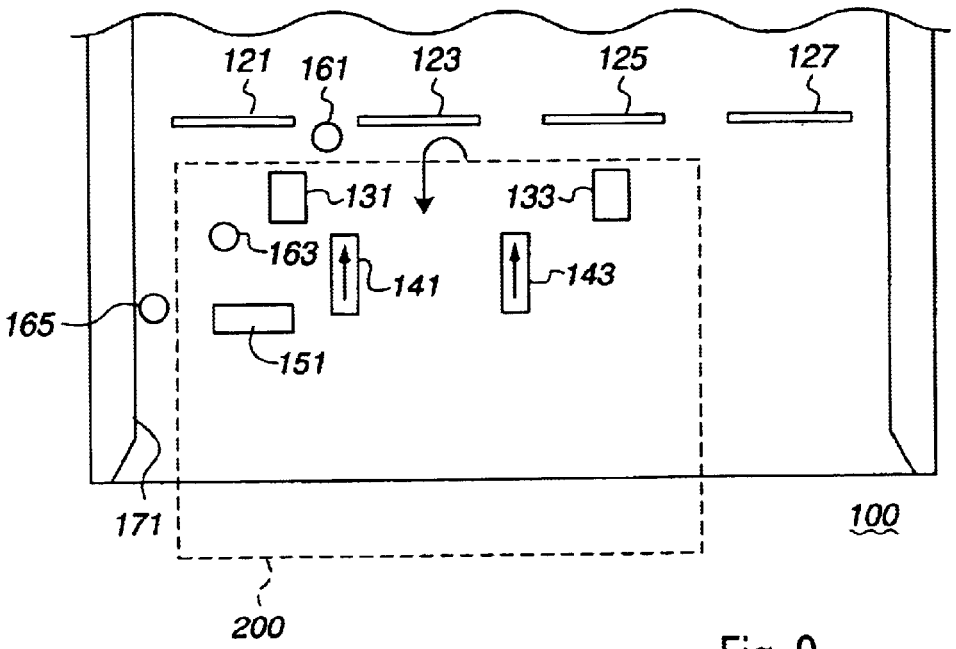
Fig. 8 (Prior Art)
Figure 9:
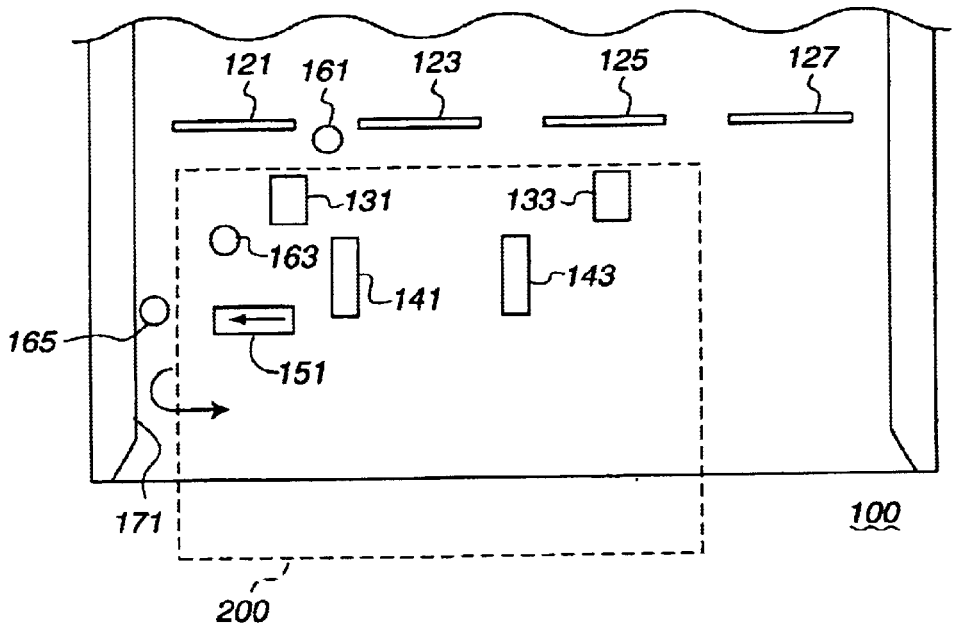
Fig. 9 (Prior Art)

FIG. 1 shows one embodiment of the medium processing device 100 of the present invention. FIG. 1 is a plan view of a portion of the medium processing device 100 parallel to a feed path. As shown in FIG. 1, a weight idler 110 is provided at a position above the medium to be processed when the medium is fed by align rollers 141, 143 and 151. The weight idler 110 in the preferred embodiment of the present invention contacts a surface of a back plate supporting the medium 200 (see FIG. 6) by its weight. When the medium 200 is inserted, the weight idler 110 rides on the medium 200 to act as a follower roller.

The reason for using the follower roller as a feed assistance member for stabilizing the feed of the medium in the preferred embodiment of the present invention is: (i) to prevent a local shearing force and a tension from being generated on the medium; (ii) to prevent the medium from being damaged and to prevent the desired feed of the medium from being obstructed; and, (iii) to cause the follower roller to easily ride on the medium.

Figure 10:
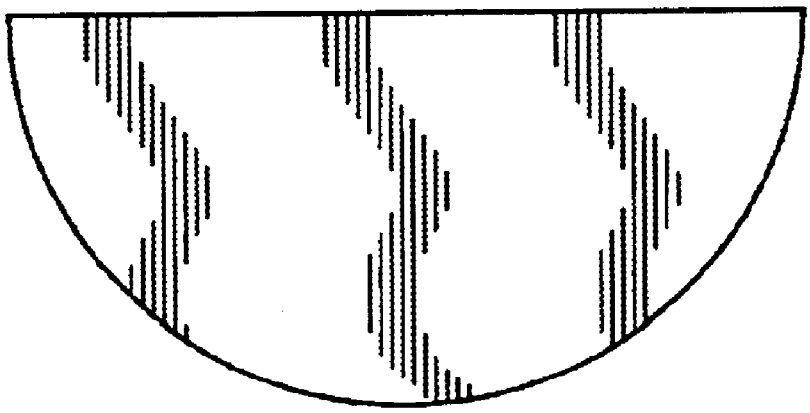
FIG. 10 illustrates a non-rotatable feed assistance member in accordance with embodiments.

Accordingly, the feed assistance member of the present invention can be realized by various members if such members have the characteristics that: can prevent the local shearing force and tension from being generated on the medium; can prevent the medium from being damaged; can prevent the desired feed of the medium from being obstructed; and, cause the follower roller to easily ride on the medium. For example, the feed assistance member can be a non-rotatable member of a hemispherical shape (FIG. 10) having a low surface friction rather than roller.

In the preferred embodiment of the present invention, the weight roller 110 is mounted between the align rollers 141, 143 and 151 and the point at which medium 200 is inserted into medium processing device 100. The axis of the weight roller 110 is aligned in a perpendicular direction to the feed direction or the vertical direction of the medium 200 to cause the weight idler 110 to easily ride on the medium 200 fed in the vertical direction.

Figure 2:
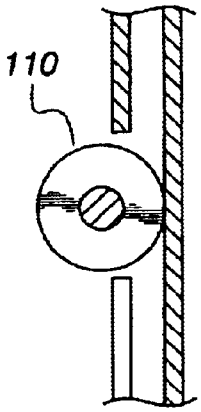
FIG. 2 shows the feed assistance member in the preferred embodiment of the present invention.
Figure 2:
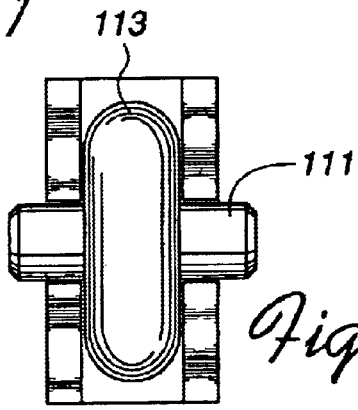
Figure 3:
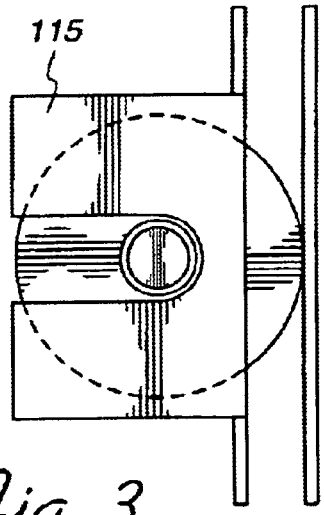
FIG. 3 shows the feed assistance member in the preferred embodiment of the present invention.
Figure 4:
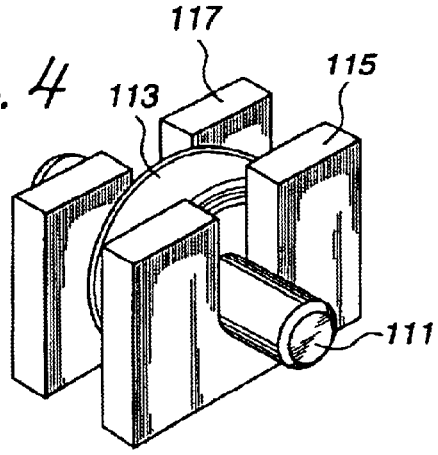
FIG. 4 shows the feed assistance member in the preferred embodiment of the present invention.
Figure 5:
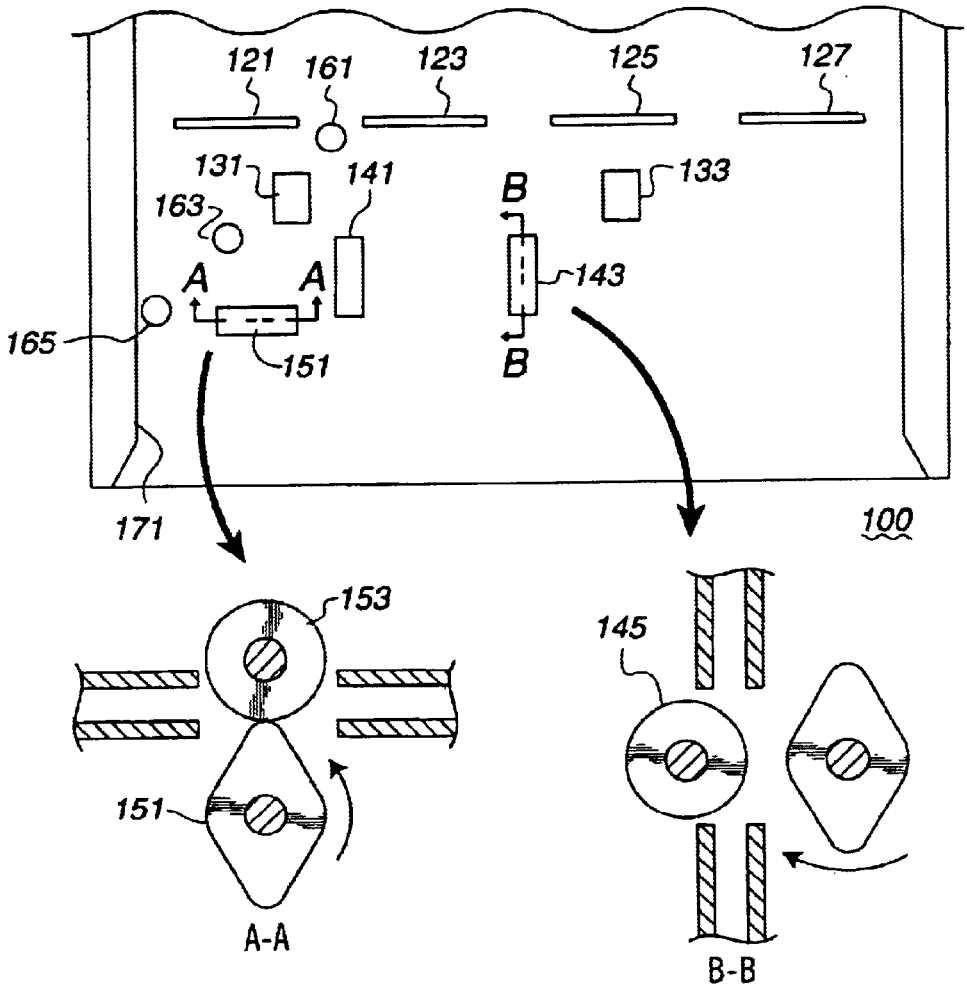
Fig. 5 (Prior Art)
FIG. 5 shows an existing medium processing device.

FIGS. 2, 3 and 4 are a plan view, a side view and a perspective view, respectively, of the weight idler 110 in the preferred embodiment of the present invention. As shown in these figures, the weight idler 110 in the preferred embodiment of the present invention comprises a weight idler shaft 111, a weight idler roller 113 and weight idler brackets 115 and 117.

The structure of the weight idler brackets 115 and 117 is such as to always move the weight idler shaft 111, held in open ended grooves, in the vertical direction, that is, in the direction along the thickness of medium 200, to the surface of the back plate supporting the medium being fed. In this manner, the total weight of the weight idler roller 113 and the weight idler shaft 111 is applied onto medium 200 even if the weight idler roller 113 is moved up and down in the vertical direction due to the thickness of the medium.

A spring may also be used for urging the weight idler onto the medium. In this case, the weight idler shaft 111 would be prevented from being locked on an upper portion of the open ended grooves of the weight idler brackets 115 or 117. If such undersired lock occurs, the weight idler 110 cannot perform its designed function. However, when a relatively thick medium 200 is inserted, the spring is additionally pressed, whereby an additional force due to the pressed spring is applied to medium 200. The friction force thus generated between the lower surface of the medium 200 and the surface of the back plate is increased since the additional force is added to the weight of the mediun. Such application of this additional force may cause a problem in some circumstance by limiting the feed of medium 200.

For example, inn the case of a passbook printer used in the banking industry, the weight of the lightest paper is about 1 gram for B6 size, and the weight of the heaviest passbook is about 20 grams. If the weight of the movable members of the weight idler 110 is 4 grams, an apparent weight of the 1 gram paper becomes 5 gram (5 times), and hence the effect for supressing the over run of the paper is large. But, in the case of the passbook, the increase of the weight is 20%, and hence the effect is small.

Desirable material for the surface of the weight idler roller is a material, such as polyacetal, nylon, or Teflon which generates a small friction with the medium at the feed operation of the medium, and does not generate a transfer of ink from the medium, which is ejected after the print operation, to the weight idler roller.

As described above, the present invention realizes the mechanism which can perform the high speed correction of position and the feed of the medium without being affected by the physical characteristic of the medium.

What is claimed is:

1. A medium feeding apparatus comprising: at least one align roller to align a medium in a path, wherein the medium is positioned in a plane defined by a first axis and a second axis, wherein the align roller is positioned below the medium and is driven to transport the medium in the path along the second axis; and a feed assistance member comprising:

(i) a shaft; and (ii) a feed assistance roller rotably mounted to the shaft and positioned to apply pressure on the medium in the path to stabilize the medium while the medium is being aligned in the path by the at least one align roller, wherein the feed assistance member is not rotably connected to the align roller, and wherein the feed assistance member and the at least one align roller are offset with respect to the second axis and wherein the feed assistance member and the at least one align roller both rotate along the second axis.

2. The medium feeding apparatus of claim 1, wherein the at least one align roller has a non-circular cross section for feeding the medium.

3. The medium feeding apparatus of claim 1, wherein the feed assistance member further comprises:

two brackets including open grooves, wherein the shaft is disposed in the grooves of the brackets.

4. The medium feeding apparatus of claim 3, comprising a spring for urging the feed assistance roller onto the medium.

5. The medium feeding apparatus of claim 3, wherein the medium is paper.

6. The medium feeding apparatus of claim 1, wherein the total weight of the feed assistance roller is applied onto the medium.

7. The medium feeding apparatus of claim 1, wherein the feed assistance roller does not contact any align roller when the medium is not positioned in the path.

8. The medium feeding apparatus of claim 1, wherein the feed assistance member and the at least one align roller contact the medium while the medium is moving along the second axis.

9. The medium feeding apparatus of claim 1, wherein the feed assistance member rotates and applies pressure to the medium in response to contacting the medium being moved by the at least one align roller.

10. A medium feeding apparatus, wherein the medium is positioned in a plane defined by a first axis and a second axis, comprising:

at least one second axis align roller to align the medium along the second axis;

a first axis align roller to align the medium along the first axis; and a feed assistance member comprising:

(i) a shaft; and (ii) a feed assistance roller rotably mounted to the shaft and positioned to apply pressure on the medium in the path to stabilize the medium while the medium is being aligned in the path by the at least one second axis align roller, wherein the feed assistance member is not rotably connected to the align rollers, wherein the feed assistance member and the at least one second axis align roller are offset with respect to the second axis, and wherein the feed assistance member is mounted between one first axis align roller and one second axis align roller.

11. The medium feeding apparatus of claim 10, wherein the feed assistance member is aligned along the second axis.

12. The medium feeding apparatus of claim 10, wherein the at least one second axis align roller comprises two second axis align rollers, and wherein the feed assistance roller is further mounted between the two second axis align rollers.

13. A medium processing device including a medium feeding apparatus to feed the medium through a feed path in the processing device, wherein the medium is positioned in a plane defined by a first axis and a second axis, and wherein the medium feeding apparatus comprises:

at least one align roller to align a medium in a path, wherein the one align roller is positioned below the medium and is driven to transport the medium in the path along the second axis; and a feed assistance member comprising:

(i) a shaft; and (ii) a feed assistance roller rotably mounted to the shaft and positioned to apply pressure on the medium in the path to stabilize the medium while the medium is being aligned in the path by the at least one align roller, wherein the feed assistance member is not rotably connected to the align roller, and wherein the feed assistance roller and the at least one align roller are offset with respect to the second axis and wherein the feed assistance roller and one align roller both rotate along the second axis.

14. The medium processing device of claim 13, wherein the processing device comprises a printer and the medium comprises paper.

15. The medium processing device of claim 13, wherein the at least one align roller has a non-circular cross section for feeding the medium.

16. The medium processing device of claim 13, wherein the feed assistance member further comprises:

two brackets including open grooves, wherein the shaft is disposed in the grooves of the brackets.

17. The medium processing device of claim 16, further comprising a spring for urging the feed assistance roller onto the medium.

18. The medium processing device of claim 13, wherein the total weight of the feed assistance roller is applied onto the medium.

19. The medium processing device of claim 13, wherein the feed assistance roller does not contact any align roller when the medium is not positioned in the path.

20. The medium processing device of claim 13, wherein the feed assistance member and the at least one align roller contacts the medium while the medium is moving along the second axis.

21. The medium processing device of claim 13, wherein the feed assistance member rotates and applies pressure to the medium in response to contacting the medium being moved by the at least one align roller.

22. A medium processing device including a medium feeding apparatus to feed the medium through feed path in the processing device, wherein the medium is positioned in a plane defined by a first axis and a second axis, and wherein the medium feeding apparatus comprises:

at least one second axis align roller to align the medium along the second axis;

a first axis align roller to align the medium along the first axis ;

a feed assistance member comprising:

(i) a shaft; and (ii) a feed assistance roller rotably mounted to the shaft and poisitioned to apply pressure on the medium in the path to stabilize the medium while the medium is being aligned in the path by the at least one second axis align roller, wherein the feed assistance member is not rotably connected to the at least one second axis align roller, wherein the feed assistance roller and the at least one second axis align roller are offset with respect to the second axis, and wherein the feed assistance member is mounted between the first axis align roller and one of the at least one second axis align roller.

23. The medium processing device of claim 22, wherein the feed assistance member is aligned along the second axis.

24. The medium processing device of claim 22, wherein the at least one second axis align roller comprises two second axis align rollers, and wherein the feed assistance roller is further mounted between the two second axis align rollers.

25. A feed assistance apparatus for feeding a medium in a medium processing apparatus, comprising:

at least one align roller for feeding the medium, wherein the medium is positioned in a plane defined by a first axis and a second axis, and wherein the align roller is positioned below the medium and is driven to transport the medium in the path along the second axis;

a member portion contacting said medium being fed to increase a frictional force generated on the medium while the medium is being aligned in the path by the at least one align roller;

wherein the member portion is not rotably connected to the at least one align roller, wherein the member portion and the at least one align roller are offset with respect to the second axis and wherein the member portion and the at least one align roller both rotate along the second axis.

26. The feed assistance apparatus of claim 25, further comprising a shaft portion supported in a bracket and disposed through said member portion, wherein the member portion rotates around said shaft portion so as to move by a force from said medium, wherein the shaft portion is not rotably connected to the at least one align roller.

27. The feed assistance apparatus of claim 25, wherein the at least one align roller has a non-circular cross section for feeding the medium.

28. The feed assistance apparatus of claim 25, wherein the member portion is aligned along the second axis with respect to medium movement.

29. The feed assistance apparatus of claim 25, wherein the medium is paper.

30. The feed assistance apparatus of claim 25, wherein the member portion does not contact any align roller when the medium is not contacting the member portion.

31. The feed assistance apparatus of claim 25, wherein the member portion does not contact any align roller when the medium is not positioned in the path.

32. The feed assistance apparatus of claim 25, wherein the member portion and the at least one align roller contacts the medium while the medium is moving along the second axis.

33. The feed assistance apparatus of claim 25, wherein the member portion rotates and applies pressure to the medium in response to contacting the medium being moved by the the at least one align roller.

34. A feed assistance apparatus for feeding a medium in a medium processing apparatus, comprising:

at least one align roller for feeding the medium, wherein the medium is positioned in a plane defined by a first axis and a second axis and transported along the second axis;

a member portion contacting said medium being fed to increase a frictional force generated on the medium while the medium is being aligned in the path by the at least one align roller;

wherein the member portion is not rotably connected to the at least one align roller, and wherein the member portion and the at least one align roller are offset with respect to the second axis, and wherein the member portion is non-rotatable.

35. A feed assistance apparatus for feeding a medium in a medium processing apparatus, wherein the medium is positioned in a plane defined by a first axis and a second axis, comprising:

at least one second axis align roller to align the medium along the second axis;

a first axis align roller to align the medium along the first axis;

a member portion contacting said medium being fed to increase a frictional force generated on the medium while th medium is being aligned the align rollers; and wherein the member portion is not rotably connected to the align rollers, and wherein the member portion and the at least one second axis align roller are offset with respect to the second axis, and wherein the member portion is mounted between the first axis align roller and one of the at least one second axis align roller.

36. The feed assistance apparatus of claim 35, wherein the at least one second axis align roller comprises two second axis align rollers, and wherein the feed assistance roller is further mounted between the two second axis align rollers.

37. A medium feeding apparatus comprising:

at least one align roller to align a medium in a path, wherein the medium is positioned in a plane defined by a first axis and a second axis and transported along the second axis; and a feed assistance member comprising:

(i) a shaft; and (ii) a member mounted to the shaft and positioned to apply pressure on the medium in the path to stabilize the medium while the medium is being aligned in the path by the at least one align roller, wherein the member and the at least one align roller are offset with respect to the second axis, and wherein the member is non-rotatable.

* * * * *

UNITED STATES PATENT AND TRADEMARK OFFICE

CERTIFICATE OF CORRECTION

PATENT NO. : 6,951,429 B2
APPLICATION NO. : 09/376651
DATED : October 4, 2005
INVENTOR(S) : Noboru Aoyama It is certified that error appears in the above-identified patent and that said Letters Patent is hereby corrected as shown below:

Title page, item [57]
Abstract
Line 8, after "one align" insert -- roller, -- .
Line 9, after "assistance" insert -- member is not rotably connected to the align roller, and wherein the feed assistance -- .

Column 4, line 65, after "claim 3," insert -- further -- .

Column 5, line 11, replace "contact" with -- contacts -- .

Column 6, line 37, replace "poisitioned" with -- positioned -- .

Column 8, line 14, delete "while th" and insert -- while the -- .
Line 14, after "being aligned" insert -- by -- .

Signed and Sealed this

Seventeenth Day of April, 2007

JON W. DUDAS
*Director of the United States Patent and Trademark Office*